US008528265B1

(12) United States Patent
Preston

(10) Patent No.: US 8,528,265 B1
(45) Date of Patent: Sep. 10, 2013

(54) LAMINATE SYSTEM

(75) Inventor: Steven S. Preston, Tampa, FL (US)

(73) Assignee: Innovations & Ideas, LLC, Tampa, FL (US)

( * ) Notice: Subject to any disclaimer, the term of this patent is extended or adjusted under 35 U.S.C. 154(b) by 82 days.

(21) Appl. No.: 13/355,895

(22) Filed: Jan. 23, 2012

Related U.S. Application Data

(63) Continuation-in-part of application No. 12/953,955, filed on Nov. 24, 2010, now abandoned, which is a continuation-in-part of application No. 12/886,872, filed on Sep. 21, 2010, now abandoned, which is a continuation-in-part of application No. 12/820,819, filed on Jun. 22, 2010, now abandoned, which is a continuation-in-part of application No. 12/658,957, filed on Feb. 18, 2010, now abandoned.

(51) Int. Cl.
*E04D 1/36* (2006.01)
*E04B 1/70* (2006.01)

(52) U.S. Cl.
USPC ..... 52/58; 52/302.1; 52/302.3; 52/305.4; 52/302.6

(58) Field of Classification Search
USPC ..... 52/58–62, 553, 302.1, 302.3, 302.4, 52/302.6
See application file for complete search history.

(56) References Cited

U.S. PATENT DOCUMENTS 5,065,553 A 11/1991 Magid
5,263,287 A * 11/1993 Lyons, Jr. ..... 52/58
5,946,870 A * 9/1999 Bifano et al. ..... 52/254
6,185,885 B1 * 2/2001 Thaler ..... 52/219
7,721,488 B1 5/2010 Bennett
2003/0177736 A1 * 9/2003 Gatherum ..... 52/741.1
2003/0230035 A1 * 12/2003 Collins et al. ..... 52/209
2005/0076853 A1 * 4/2005 Leo ..... 119/497
2005/0246987 A1 * 11/2005 Hatzinikolas ..... 52/302.1
2009/0031640 A1 * 2/2009 Elmes et al. ..... 52/60
2010/0139178 A1 * 6/2010 Ehrman et al. ..... 52/58
2010/0281612 A1 * 11/2010 Cook ..... 4/614
2010/0287863 A1 * 11/2010 Goldberg et al. ..... 52/302.1
2011/0277393 A1 * 11/2011 Hohmann, Jr. ..... 52/62
2012/0042582 A1 * 2/2012 Hohmann, Jr. ..... 52/62

OTHER PUBLICATIONS

Tamlyn & Sons, LP, ColorPlus Flashing, http://tamlyn.com/colorplusflashing/plankflashing.html, 2009, accessed on Jun. 15, 2010.
Tamlyn & Sons, LP, Xtreme Trim for Use with Fiber Cement Siding and Soffit, http://tamlyn.com/xtremetrim/images/pdf/Xtreme%20Trim%20Catalog.pdf, 2010, accessed on Jun. 15, 2010.
Flashing by Design, Inc., Galvanized Flashing Specifications: Slip Sheets, Brick Flashing, Window Flashing and More, http://www.flashingbydesign.com/html/flashing-specifications.html, 2009, accessed on Jun. 15, 2010.

* cited by examiner

*Primary Examiner* — Mark Wendell
(74) *Attorney, Agent, or Firm* — Christopher Paradies; Paradies Law P.A.

(57) ABSTRACT

A laminate system for use in building construction adapted to be positioned between a substrate material and an exterior material to avert the passage of water between the exterior material and the substrate material. The laminate system includes any combination of a rigid backer, a gasket, one or more substantially waterproof/water-resistant membrane, and one or more peel away sheets entirely covering the one or more membranes.

18 Claims, 13 Drawing Sheets

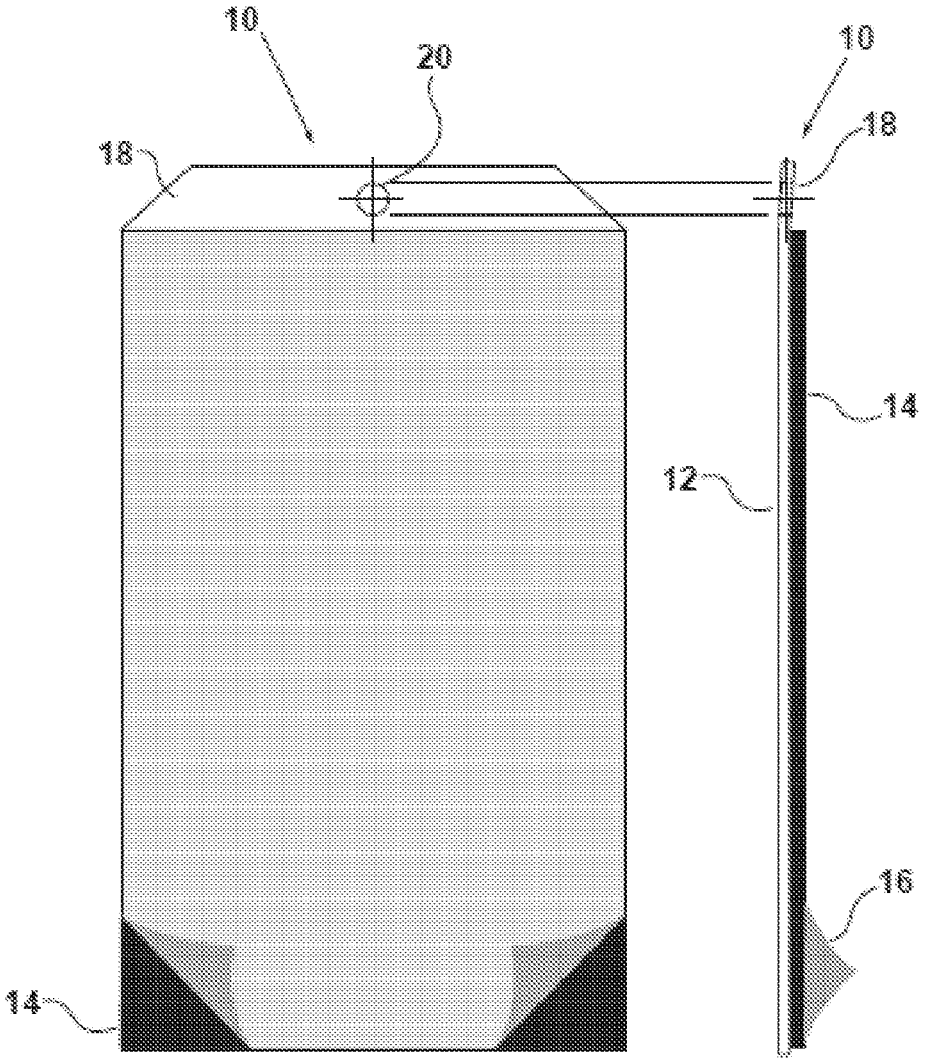
*FIG. 2(a)* *FIG. 2(b)*

LAMINATE SYSTEM

CROSS REFERENCE TO RELATED APPLICATION

This application is a continuation-in-part of currently pending U.S. patent application Ser. No. 12/953,955, entitled "LAMINATE SYSTEM," filed Nov. 24, 2010, which is a continuation-in-part of currently pending U.S. patent application Ser. No. 12/886,872, entitled "LAMINATE SYSTEM WITH COMPRESSION RECOVERY GASKET," filed Sep. 21, 2010, which is a continuation-in-part of currently pending U.S. patent application Ser. No. 12/820,819, entitled "LAMINATE SYSTEM," filed on Jun. 22, 2010, which is a continuation-in-part of currently pending U.S. patent application Ser. No. 12/658,957, entitled "HIDDEN BUTT JOINT FLASHING SYSTEM," filed on Feb. 18, 2010, the contents of which are all hereby incorporated by reference.

BACKGROUND OF THE INVENTION

1. Field of the Invention

The present invention relates, generally, to laminate systems for use in building construction. More specifically, it relates to a laminate or gasket system for use in waterproofing the exterior building envelope.

2. Description of the Prior Art

Laminates are known in the prior art. While laminate systems fulfill their respective, particular objectives and requirements, laminate systems that adequately prevent water from penetrating substrate materials do not exist.

Unsuccessful attempts have been made at preventing moisture from penetrating substrate materials, examples being U.S. Pat. No. 7,721,488 ("Bennett") and U.S. Pat. No. 5,065,553 ("Magid"). Bennett discloses a flashing apparatus that intends "to provide a certain level of water resistance in the seams between the ends of the sections of the siding." (abstract, Bennett). Bennett includes a flashing panel, but does not provide sufficient water resistance since no seal, gasket or drain trough is created between the flashing panel and exterior material, thereby allowing penetration of moisture. Magid discloses a roof flashing unit with a flexible waterproof membrane. The membrane remains on the exterior of the roof flashing unit, so the membrane is the roofing material. Significant issues arise in Magid, including that the waterproof membrane is exposed to climatic conditions and attempts to block the conditions from the underneath metal sheet using one membrane that is substantially the same size as the metal sheet. This is insufficient, as a seal, gasket or drain trough is not created between the sheet and exterior material, and moisture and other debris would tend to leak into the flashing and substrate materials.

Therefore, it can be appreciated that there exists a long felt but unfulfilled need for a new and improved laminate system that can prevent water from penetrating substrate materials. However, in view of the prior art considered as a whole at the time the present invention was made, it was not obvious to those of ordinary skill in the art how the limitations of the art could be overcome, including how a laminate system could prevent water from penetrating substrate materials.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF INVENTION

The long-standing but heretofore unfulfilled need for an improved laminate system that can prevent water from penetrating substrate materials is now met by a new, useful, and nonobvious invention.

Generally speaking, the laminate system is used during building construction to avert the passage of water between an exterior material and a substrate material.

In a first embodiment, the laminate system includes a substantially waterproof/water-resistant membrane disposed on a generally rigid backer.

In a second embodiment, the laminate system includes a substantially waterproof/water-resistant membrane disposed in overlying relation to a resilient material that is disposed in overlying relation to a generally rigid backer. The resilient material is disposed between the rigid backer and the substantially waterproof/water-resistant membrane. As the laminate system is sandwiched between the substrate material and exterior material, the resilient material compresses. The recoil of the resilient material ensures that the substantially waterproof/water-resistant membrane is securely forced against the exterior material regardless of imperfections or voids in the exterior material.

In a third embodiment, the resilient material is disposed in overlying relation to a first side of the rigid backer and the substantially waterproof/water-resistant membrane is disposed in overlying relation to a second side of said rigid backer. A second substantially waterproof/water-resistant membrane may additionally be disposed in overlying relation to the resilient material.

In a fourth embodiment, the laminate system may include a peel away sheet disposed in overlying relation to the substantially waterproof/water-resistant membrane. The peel away sheet is removed at the time of installation to expose the adhesive properties that the substantially waterproof/water-resistant membrane may contain.

In a fifth embodiment, the laminate system includes a plurality of substantially waterproof/water-resistant membranes disposed in overlying relation to a first side of a rigid backer. In a further embodiment, peel away sheets may be disposed in overlying relation to the plurality of substantially waterproof/water-resistant membranes. The peel away sheets are removed at the time of installation to expose the adhesive properties that the substantially waterproof/water-resistant membrane may contain.

The laminate system can vary in shape and size depending on the task, for example butt joint flashings and trim flashings. In a particular embodiment, the laminate system includes a hidden butt joint flashing system. The hidden butt joint flashing system includes a flashing panel having a substantially waterproof/water-resistant membrane secured in overlying relation to a front surface of the flashing panel. A peel away sheet can cover the substantially waterproof/water-resistant membrane.

The upper edge of the flashing panel may be bent forward to form a downward 45 degree angle with the flashing panel. Moreover, a top flange may project from an upper edge of the flashing panel and is angled between 0-45 degrees. Additionally, a top flange may be bent forward to form a 90 degree angle with the flashing panel. The top flange may further include a nail hole.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 1(*b*) depicts a front view of a laminate system having a generally rigid backer with attached substantially waterproof/water-resistant membrane and optional peel away sheet;

FIG. 2(*a*) depicts a front view of a laminate system having an angled top flange;

FIG. 2(*b*) depicts a side view of a laminate system having an angled top flange;

FIG. 3(*b*) depicts a side view of a laminate system having an upper edge bent downward at a 45 degree angle;

FIG. 4(*b*) depicts a front view of a laminate system having two substantially waterproof/water-resistant membranes and optional peel away sheets;

FIG. 5(*b*) depicts a front view of a laminate system having a plurality of substantially waterproof/water-resistant membranes;

FIG. 6(*b*) depicts a front view of a laminate system having a plurality of substantially waterproof/water-resistant membranes with top flanges disposed at a 90 degree angle between the membranes;

FIG. 6(*c*) depicts an upper perspective view of a laminate system having a plurality of substantially waterproof/water-resistant membranes with top flanges disposed at a 90 degree angle between the membranes;

FIG. 7(*b*) depicts a front view of a laminate system with an optional i-shaped slide;

FIG. 8(*b*) depicts a front view of a laminate system for use as a trim piece, the laminate system having a plurality of substantially waterproof/water-resistant membranes and an optional i-shaped slide FIG. 9(*a*) depicts a top view of a laminate system for use as a trim piece, the laminate system having an optional i-shaped slide and no substantially waterproof/water-resistant membranes;

FIG. 11(*b*) depicts a front view of a laminate system for use as a trim piece, the laminate system having a gasket and a plurality of substantially waterproof/water-resistant membrane FIG. 12(*a*) depicts a top view of a laminate system for use as a trim piece, the laminate system having a gasket, a plurality of substantially waterproof/water-resistant membrane and a top flange;

DETAILED DESCRIPTION OF THE PREFERRED EMBODIMENT

Figure 1A:
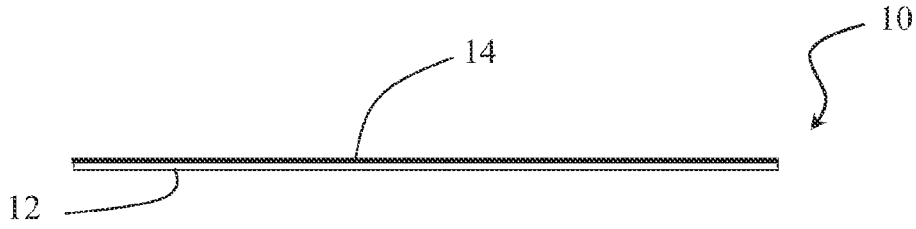
FIG. 1(*a*) depicts a top view of a laminate system having a generally rigid backer with attached substantially waterproof/water-resistant membrane and optional peel away sheet.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

In an embodiment, the laminate system, or assembly, includes a combination of two materials laminated together to create a gasket system using a rigid backer, being a flashing panel, and one or more substantially waterproof/water-resistant membranes. The rigid backer can be made of any metal, plastic, synthetic product or other suitable material and can be bent in any fashion. For example, the backer can be bent or formed for use as a butt joint flashing and/or trim flashing.

Accordingly, in an example embodiment, the laminate system may include a rubberized waterproof membrane laminated to a shaped aluminum backer. The aluminum acts as a rigid backer for the membrane so the membrane can create a tight seal between the aluminum backer and an exterior material, creating a seal or gasket, to avert the passage of water between the exterior material and a substrate material. The membrane may also act as an adhesive surface.

The substantially waterproof/water-resistant membrane may be any suitable waterproof/water-resistant material. For example, the substantially waterproof/water-resistant membrane may include rubber, rubberized asphalt, foam, silicone, synthetics, EPDM (ethylene propylene diene monomer) or any other suitable material, individually or in combination, to avert the passage of moisture.

A peel away sheet may be disposed in overlying relation to the substantially waterproof/water-resistant membrane and removed at the time of installation to expose the adhesive properties, if any, of the substantially waterproof/water-resistant membrane. If more than one substantially waterproof/water-resistant membrane is present on the device, peel away sheets may be disposed in overlying relation to one or more of the membranes. If the substantially waterproof/water-resistant membrane does not include adhesive properties, a peel away sheet is not needed but may nevertheless be included.

In another embodiment, the laminate includes a combination of two materials laminated together to create a gasket system using a rigid backer, a resilient material, and a substantially waterproof/water-resistant membrane. The rigid backer can be made of any metal, plastic or synthetic product and can be bent in any fashion. For example, the backer can be bent or formed for use as a butt joint flashing and/or trim flashing. Likewise, the substantially waterproof/water-resistant membrane and gasket can be any otherwise suitable material to avert the passage of water, including, but not limited to, rubber, foam, silicone, synthetics, and EPDM, individually or in combination. The gasket may be any suitable size desired by the user, for example ¼"×¼", and can be any desired shape, such as a square cross section, as depicted herein.

If a resilient material is used, it can be disposed between the rigid backer and the peel away sheet. The resilient material compresses as the laminate system is sandwiched between the substrate material and exterior material after the peel away strip has been removed. The recoil of the resilient material ensures that the substantially waterproof/water-resistant membrane is securely forced against the exterior material, creating a seal or gasket, regardless of imperfections or voids in the exterior material. It is also contemplated that the resilient material can be disposed between the rigid backer and the substantially waterproof/water-resistant membrane. A second substantially waterproof/water-resistant membrane may additionally be disposed in overlying relation to the resilient material.

The resilient material can be any suitable resilient material, for example compression foam, plastics, synthetics or other suitable material. The resilient material may be any thickness and resiliency necessary to ensure sufficient recoil for pressing the substantially waterproof/water-resistant membrane against the exterior or substrate material.

The novel laminate system is used in building construction and can be sandwiched between a substantially planar substrate and a substantially planar exterior surface covering. The substrate can be any suitable materials used in building construction, such as stucco, plywood, any wall sheathing, etc. The exterior surface covering can be any suitable materials, such as cement fiber, vinyl, wood composite products, aluminum, etc. The laminate system may create a seal and/or interstitial drain trough between the rigid backer and exterior surface covering via the substantially waterproof/water-resistant membranes. The system can be used without the membranes as well to avert the passage or accumulation of moisture.

Example 1

Figure 1B:
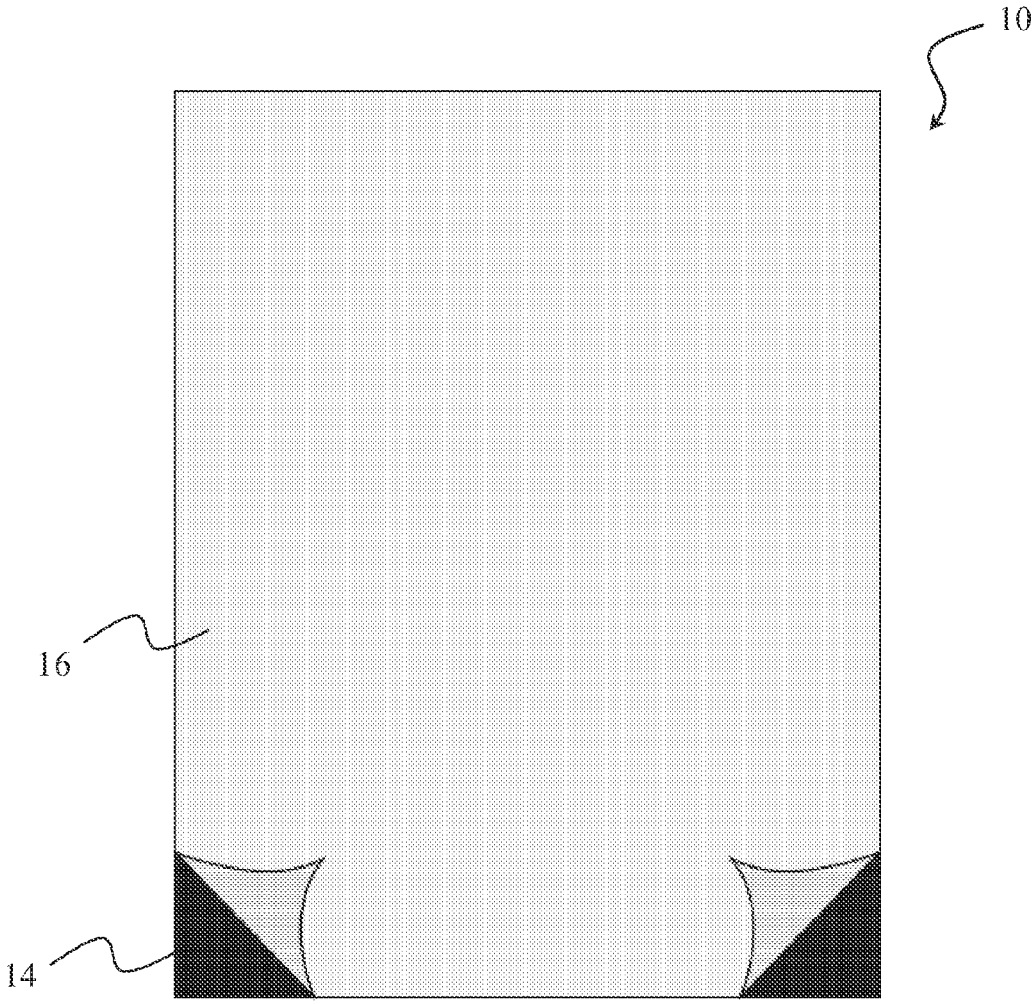

As depicted in FIGS. 1(*a*)-(*b*), an embodiment of the laminate system includes a hidden butt joint flashing, generally denoted by the reference 10. Flashing 10 can be generally rectangular in shape and includes rigid backer 12 having an upper edge, a lower edge, a first side edge, a second side edge, a front surface, and a rear surface.

Substantially waterproof/water-resistant membrane material 14 is disposed vertically on the front surface of rigid backer 12 and is adapted to avert the passage of water between an exterior material and a substrate material by creating a drain trough.

Peel away sheet 16 can be disposed in overlying relation to substantially waterproof/water-resistant membrane material 14. Peel away sheet 16 is removed at the time of installation to expose the adhesive properties that substantially waterproof/water-resistant membranes 14 may contain.

Example 2

As depicted in FIGS. 2(*a*)-(*b*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

Substantially waterproof/water-resistant membrane material 14 is disposed vertically on the front surface of rigid backer 12 and is adapted to avert the passage of water between an exterior material and a substrate material by creating a drain trough.

Peel away sheet 16 can be disposed in overlying relation to substantially waterproof/water-resistant membrane material 14. Peel away sheet 16 is removed at the time of installation to expose the adhesive properties that substantially waterproof/water-resistant membranes 14 may contain.

Flashing 10 includes top flange 18 that projects up and out at an angle between 0 degrees and about 45 degrees from the upper edge of backer 12. In use, top flange 18 is positioned parallel to a wall. Nail hole 20 can be disposed within top flange 18 to enable flashing 10 to be nailed in place prior to the installation of siding.

Example 3

Figure 3A:
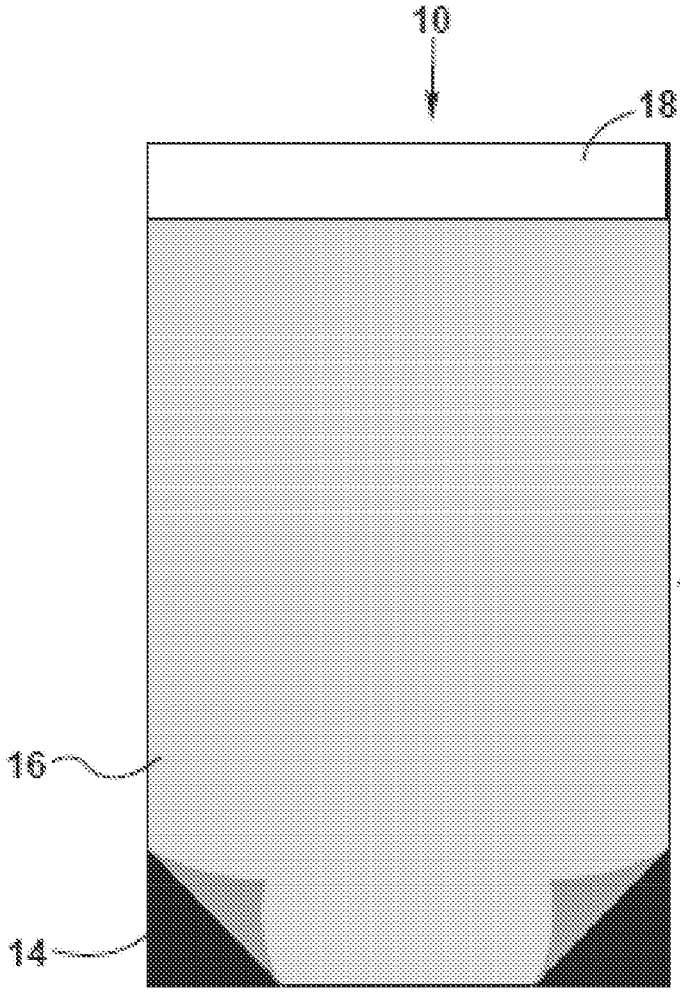
FIG. 3(*a*) depicts a front view of a laminate system having an upper edge bent downward at a 45 degree angle.
Figure 3B:
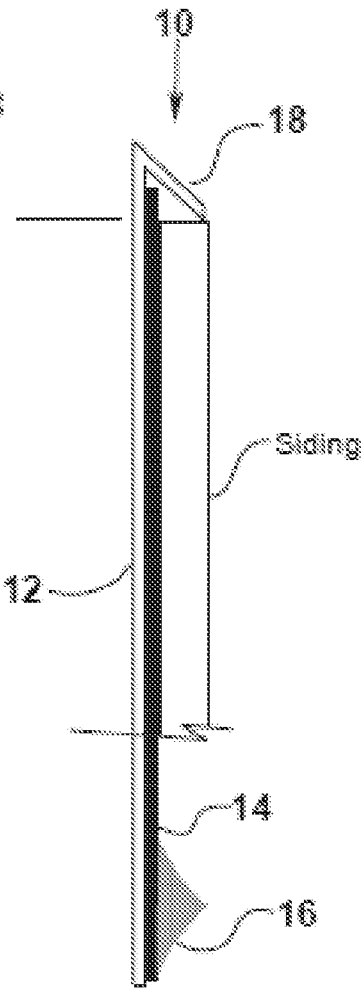

As depicted in FIGS. 3(*a*)-3(*b*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

Substantially waterproof/water-resistant membrane material 14 is disposed vertically on the front surface of rigid backer 12 and is adapted to avert the passage of water between an exterior material and a substrate material.

Peel away sheet 16 can be disposed in overlying relation to substantially waterproof/water-resistant membrane material 14. Peel away sheet 16 is removed at the time of installation to expose the adhesive properties that substantially waterproof/water-resistant membranes 14 may contain.

Flashing 10 includes top flange 18 that is bent downward at about a 45 degree angle and towards the front surface of rigid backer 12. Other angles, as desired by the user, are contemplated by the current invention. The bent lip of upper edge 18 may help shed water out of a wall cavity from any leaking joints above the same vertical line. It also creates a cavity underneath the lip to reduce direct contact with the siding, allowing ventilation and reducing potential condensation and corrosion.

Example 4

Figure 4A:
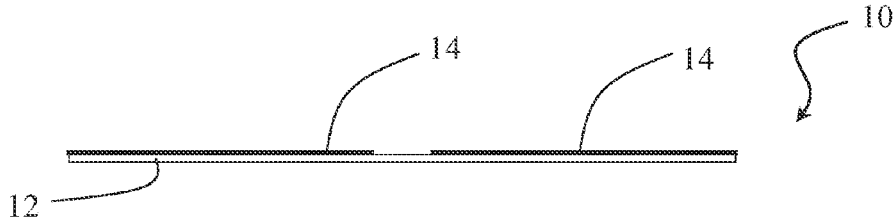
FIG. 4(*a*) depicts a top view of a laminate system having two substantially waterproof/water-resistant membranes, creating a drain trough, and optional peel away sheets.
Figure 4B:
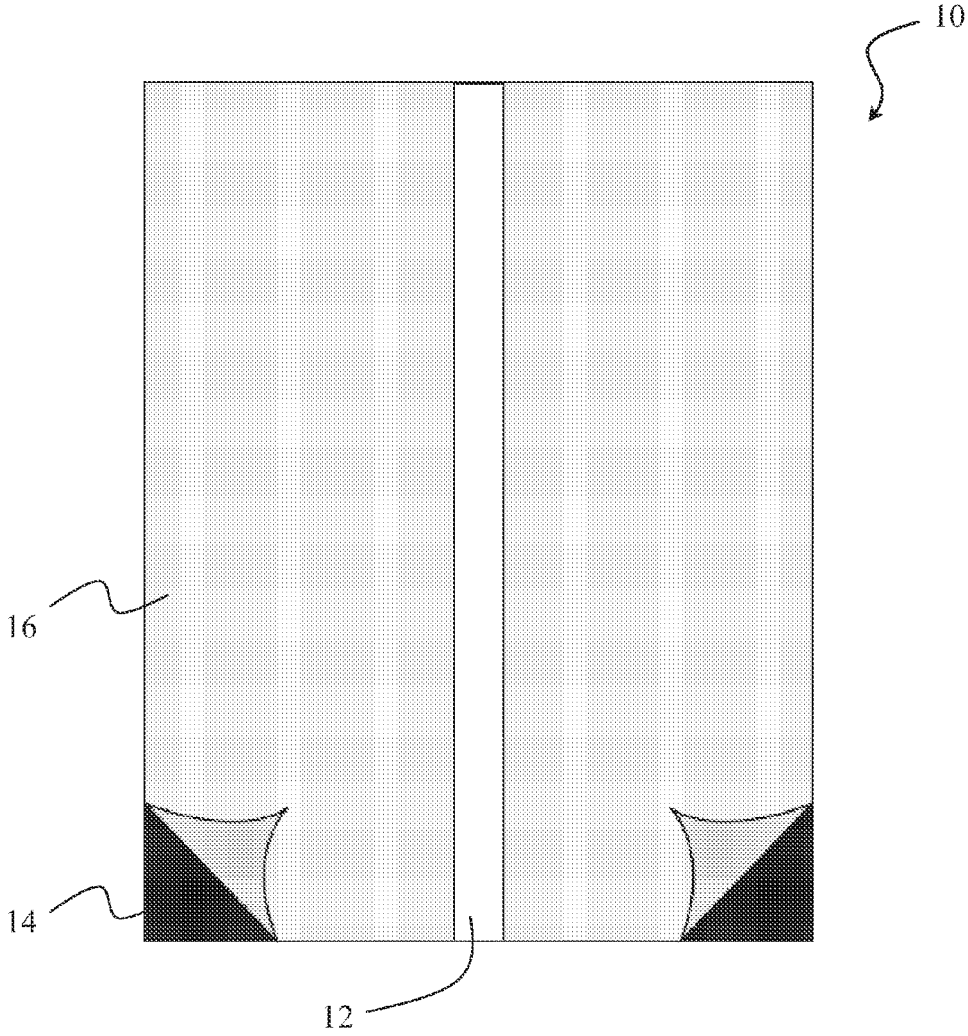

As depicted in FIGS. 4(*a*)-(*b*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

Two substantially waterproof/water-resistant membranes 14 are disposed vertically on the front surface of rigid backer 12 and are adapted to avert the passage of water between an exterior material and a substrate material by creating a drain trough.

Peel away sheets 16 can be disposed in overlying relation to substantially waterproof/water-resistant membranes 14. Peel away sheets 16 are removed at the time of installation to expose the adhesive properties that substantially waterproof/water-resistant membranes 14 may contain.

Flashing 10 may include top flange (not shown) and nail hole (not shown) as depicted and described in Examples 2 and 3.

Example 5

Figure 5A:
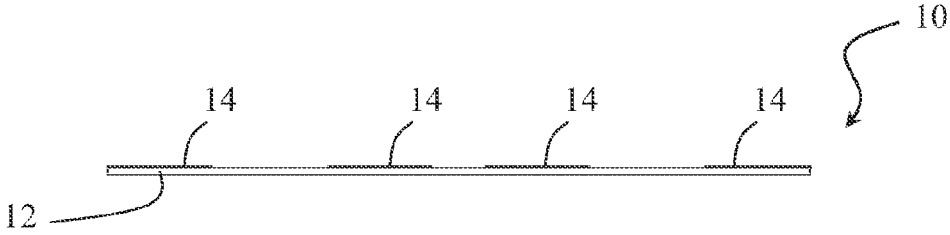
FIG. 5(*a*) depicts a top view of a laminate system having a plurality of substantially waterproof/water-resistant membranes.
Figure 5B:
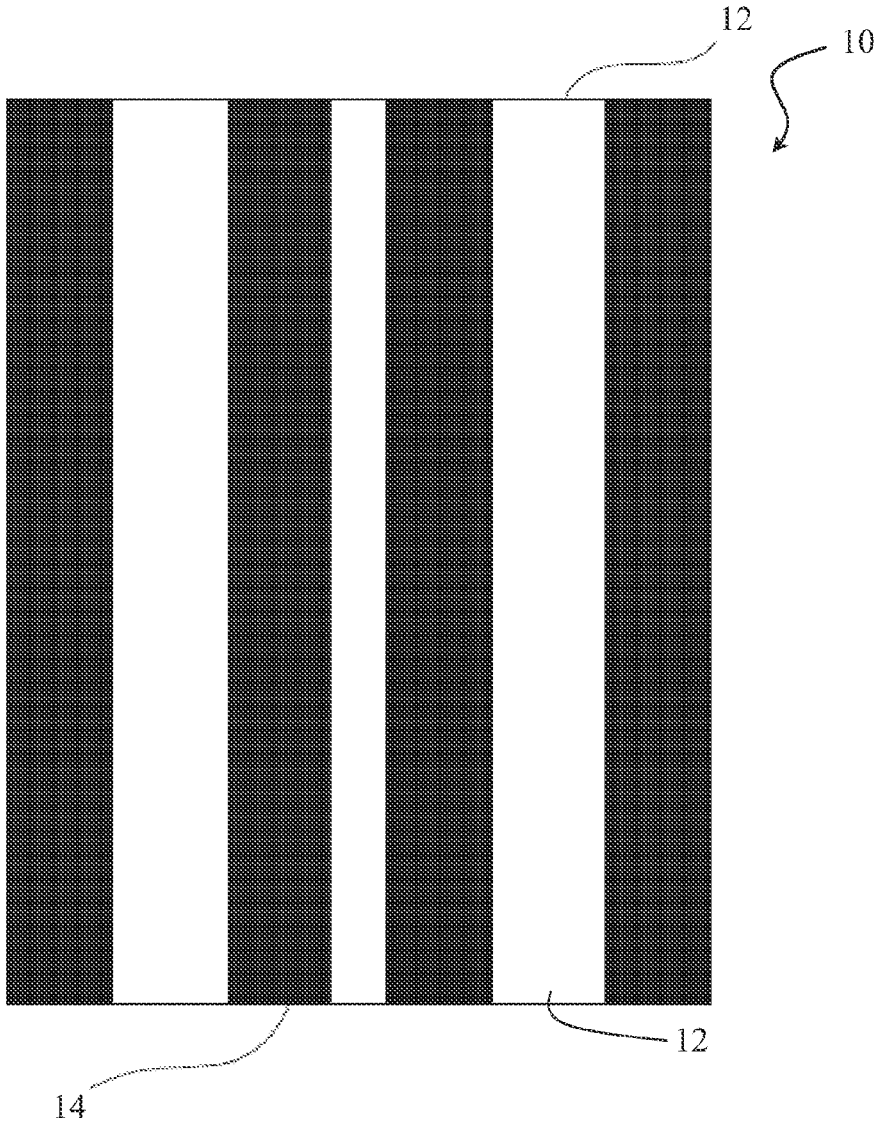

As depicted in FIGS. 5(*a*)-(*b*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

A plurality of substantially waterproof/water-resistant membranes 14 are disposed vertically on the front surface of rigid backer 12 and are adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Flashing 10 may include top flange (not shown) and nail hole (not shown) as depicted and described in Examples 2 and 3.

Example 6

Figure 6A:
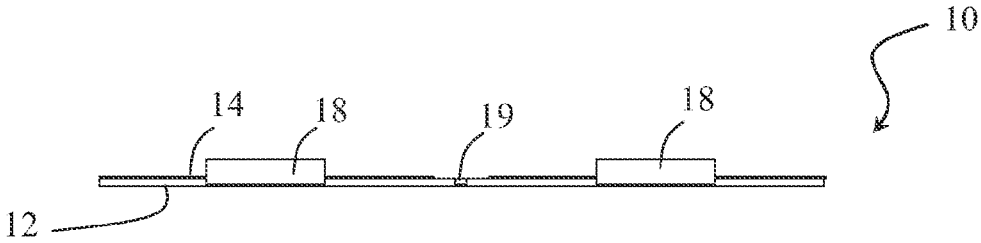
FIG. 6(*a*) depicts a top view of a laminate system having a plurality of substantially waterproof/water-resistant membranes with top flanges disposed at a 90 degree angle between the membranes.
Figure 6B:
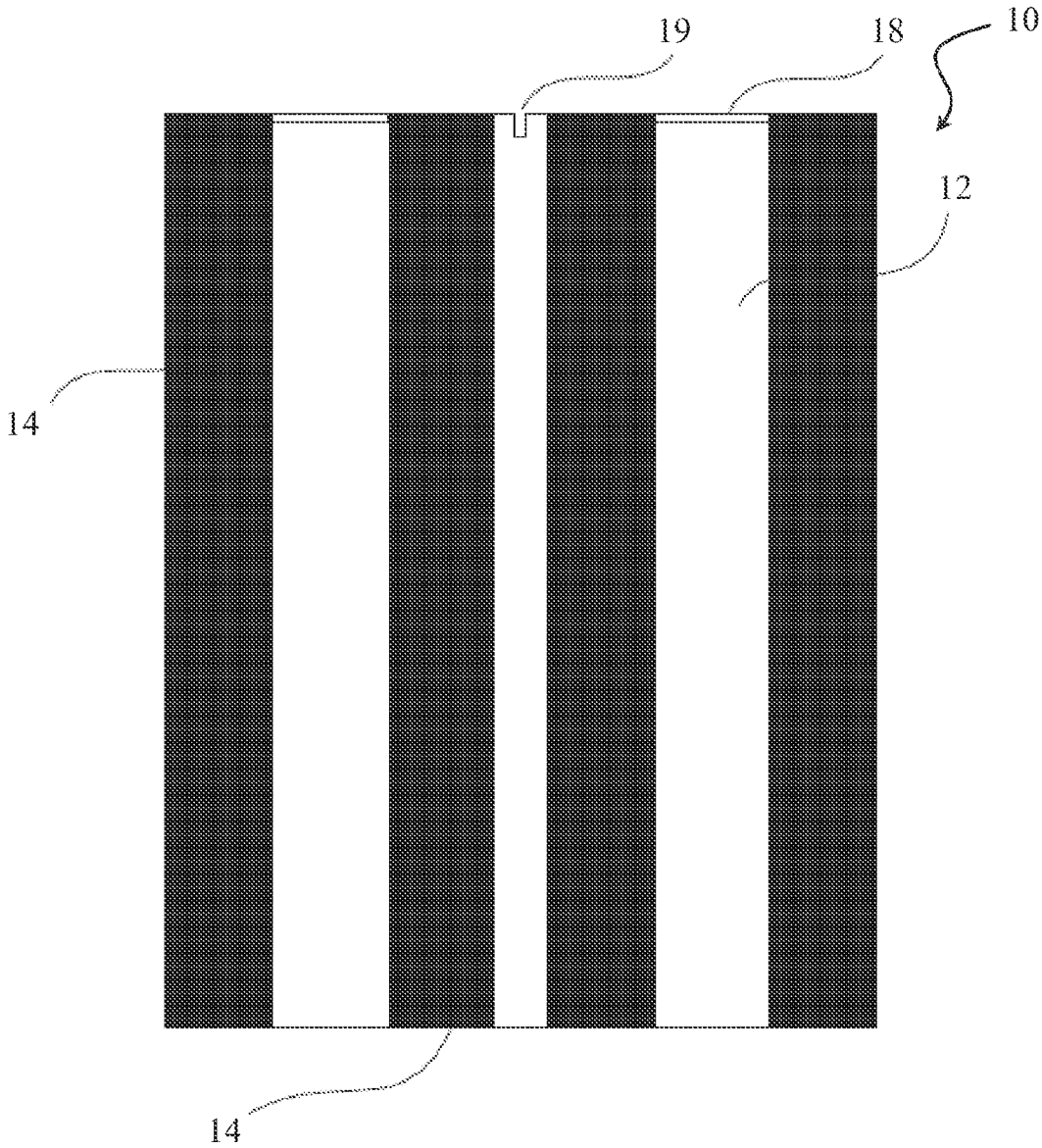
Figure 6C:
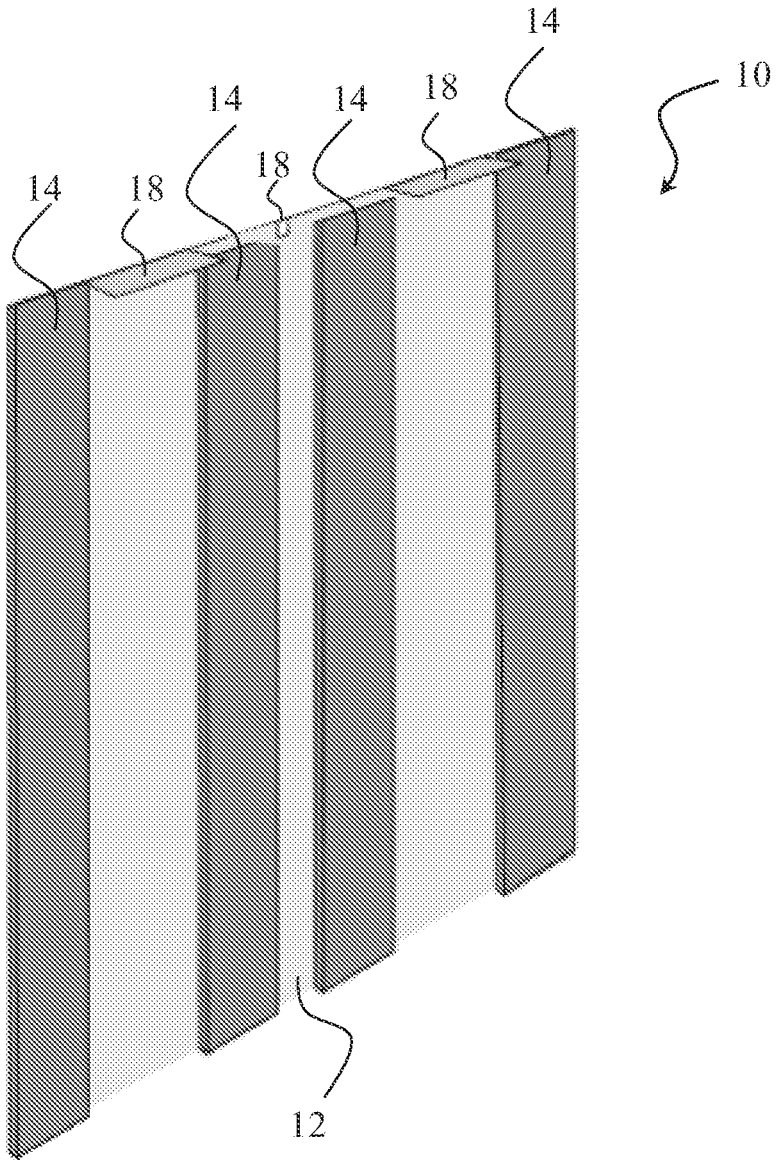

As depicted in FIGS. 6(*a*)-6(*c*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

A plurality of substantially waterproof/water-resistant membranes 14 is disposed vertically on the front surface of rigid backer 12 and is adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Flashing 10 includes top flange 18 that projects outward at an angle of about 90 degrees from the upper edge of backer 12 towards the front surface of rigid backer 12, creating a horizontal shoulder. In use, top flange 18 is positioned perpendicular to a wall. The bent lip of top flange 18 may help secure the flashing 10 in place, as top flange 18 can fit between juxtaposed sidings. Top flange 18 may also help simplify manufacturing and indicate where to attach a nail/fastener on the corresponding membrane to create the seal or gasket that prevents water intrusion.

Notch 19 may be disposed along the upper edge of rigid backer 12 at a position desired by a user. Notch 19 can be used for the center placement of flashing 10.

Example 7

Figure 7A:
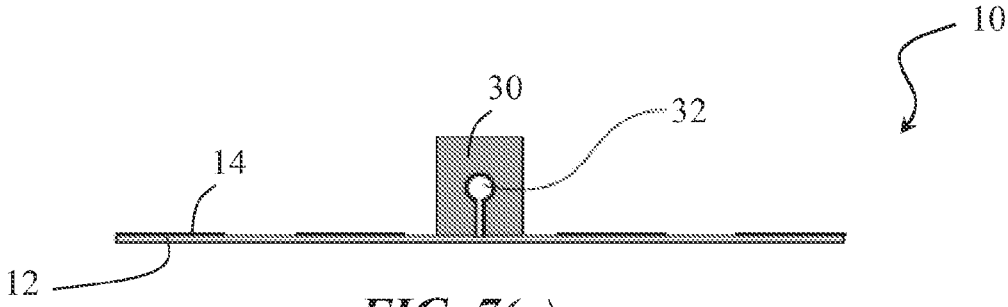
FIG. 7(*a*) depicts a top view of a laminate system with an optional i-shaped slide.
Figure 7B:
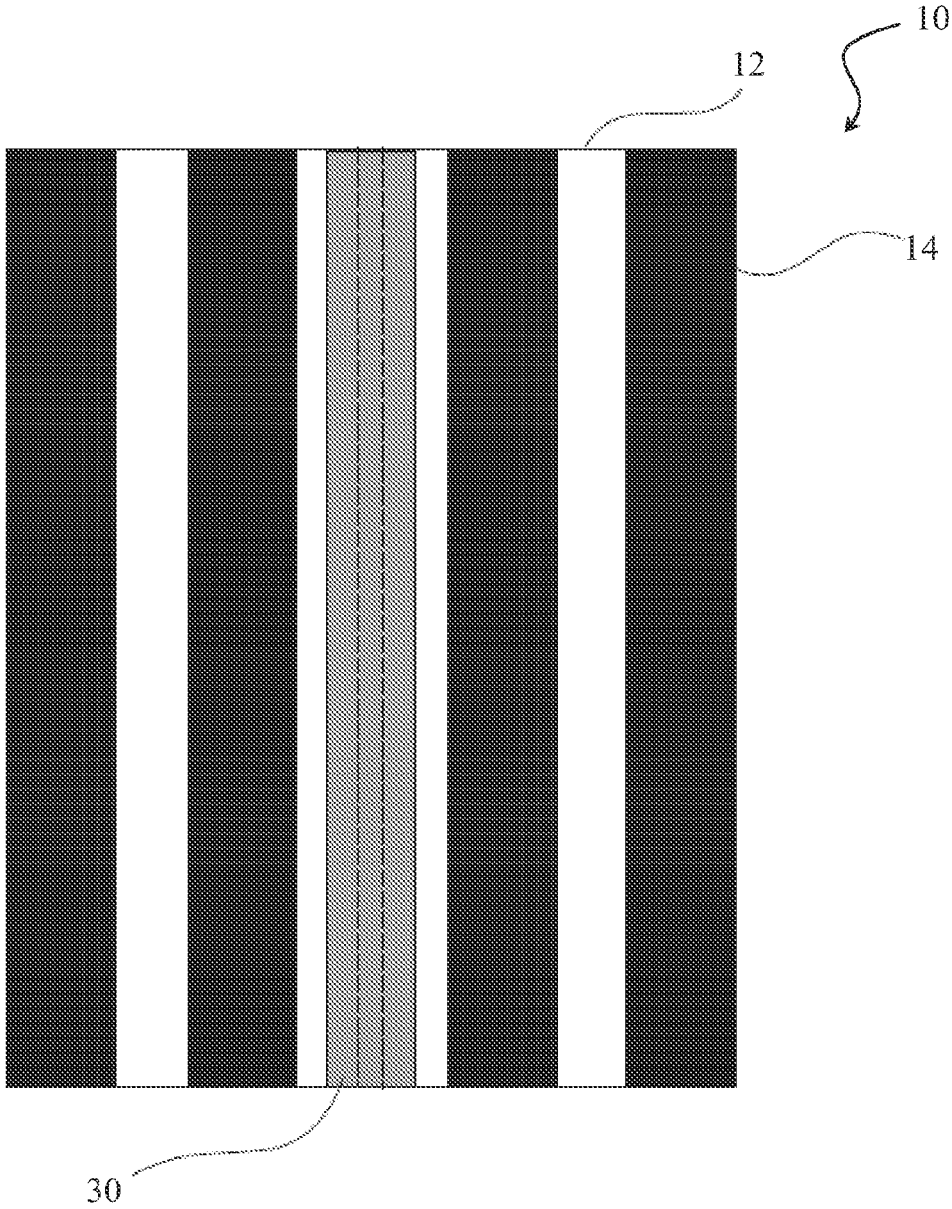

As depicted in FIGS. 7(*a*)-7(*b*), an embodiment of the laminate system includes a hidden butt joint flashing 10. Flashing 10 can be generally rectangular in shape and includes rigid backer 12 having an upper edge, a lower edge, a first side edge, a second side edge, a front surface, and a rear surface.

A plurality of substantially waterproof/water-resistant membranes 14 is disposed vertically on the front surface of rigid backer 12 and is adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Rigid backer 12 terminates at gasket 30 using i-shaped slide 32, which serves the purpose of securing flashing 10 into gasket 30. Gasket 30 has approximately the same vertical length as flashing 10 and is disposed vertically along the front surface of the rigid backer. Gasket 30 has an i-shaped void that matches i-shaped slide 32, such that the i-shaped slide 32 can be inserted and fit snugly in the i-shaped void. Though the shape present in this embodiment resembles an "i", the invention contemplates any shape for the slide and/or for the void to achieve the same result.

Example 8

Figure 8A:
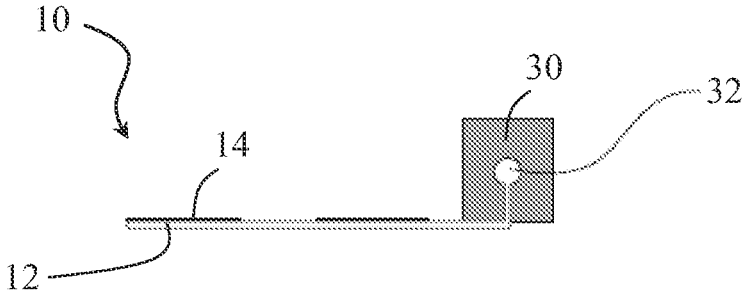
FIG. 8(*a*) depicts a top view of a laminate system for use as a trim piece, the laminate system having a plurality of substantially waterproof/water-resistant membranes and an optional i-shaped slide.
Figure 8B:
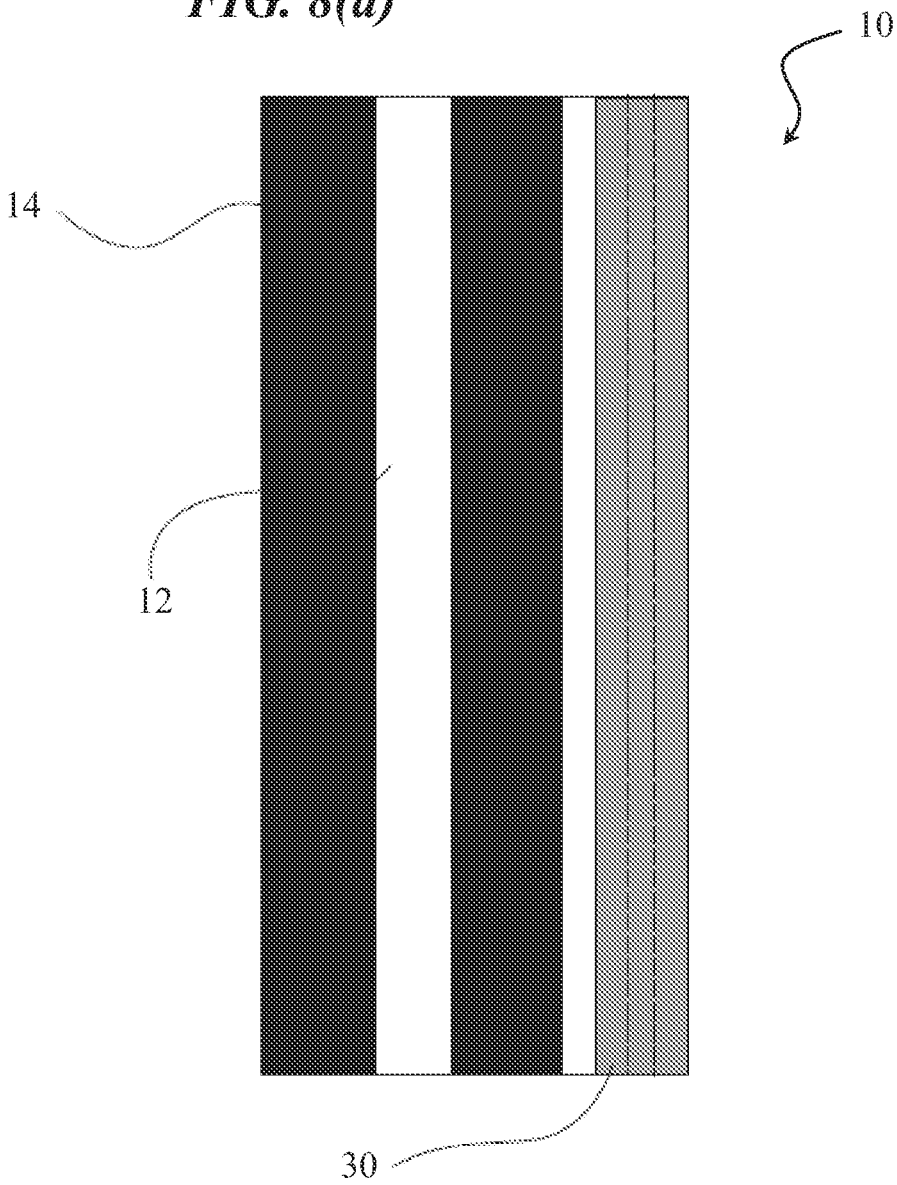

As depicted in FIGS. 8(*a*)-8(*b*), an embodiment of the laminate system includes a flashing 10 used as a trim piece. Flashing 10 can be generally rectangular in shape and includes rigid backer 12 having an upper edge, a lower edge, a first side edge, a second side edge, a front surface, and a rear surface. In this embodiment, rigid backer 12 extends and terminates at gasket 30, whereas rigid backer 12 extends to the opposite side of gasket 30 in FIGS. 7(*a*)-7(*b*). Gasket 30 may replace caulk and can be used as an aid for placement of flashing 10. Gasket 30 has approximately the same vertical length as flashing 10 and is disposed along a vertical edge of rigid backer 12.

A plurality of substantially waterproof/water-resistant membranes 14 is disposed vertically on the front surface of rigid backer 12 and is adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Rigid backer 12 terminates at gasket 30 using i-shaped slide 32, which serves the purpose of securing flashing 10 into gasket 30. Gasket 30 has an i-shaped void that matches i-shaped slide 32, such that the i-shaped slide 32 can be inserted and fit snugly in the i-shaped void. Though the shape present in this embodiment is an "i", the invention contemplates any shape for the slide and/or for the void to achieve the same result.

Example 9

Figure 9A:
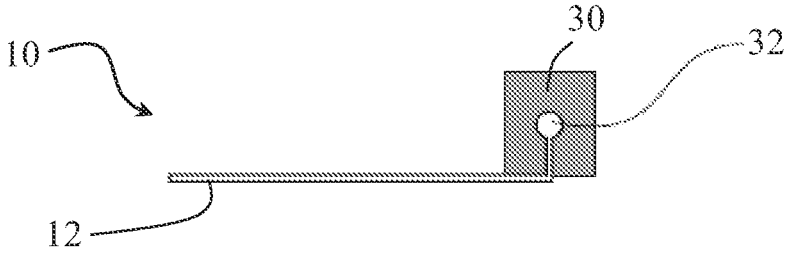
FIG. 9(*b*) depicts a front view of a laminate system for use as a trim piece, the laminate system having an optional i-shaped slide and no substantially waterproof/water-resistant membranes.
Figure 9B:
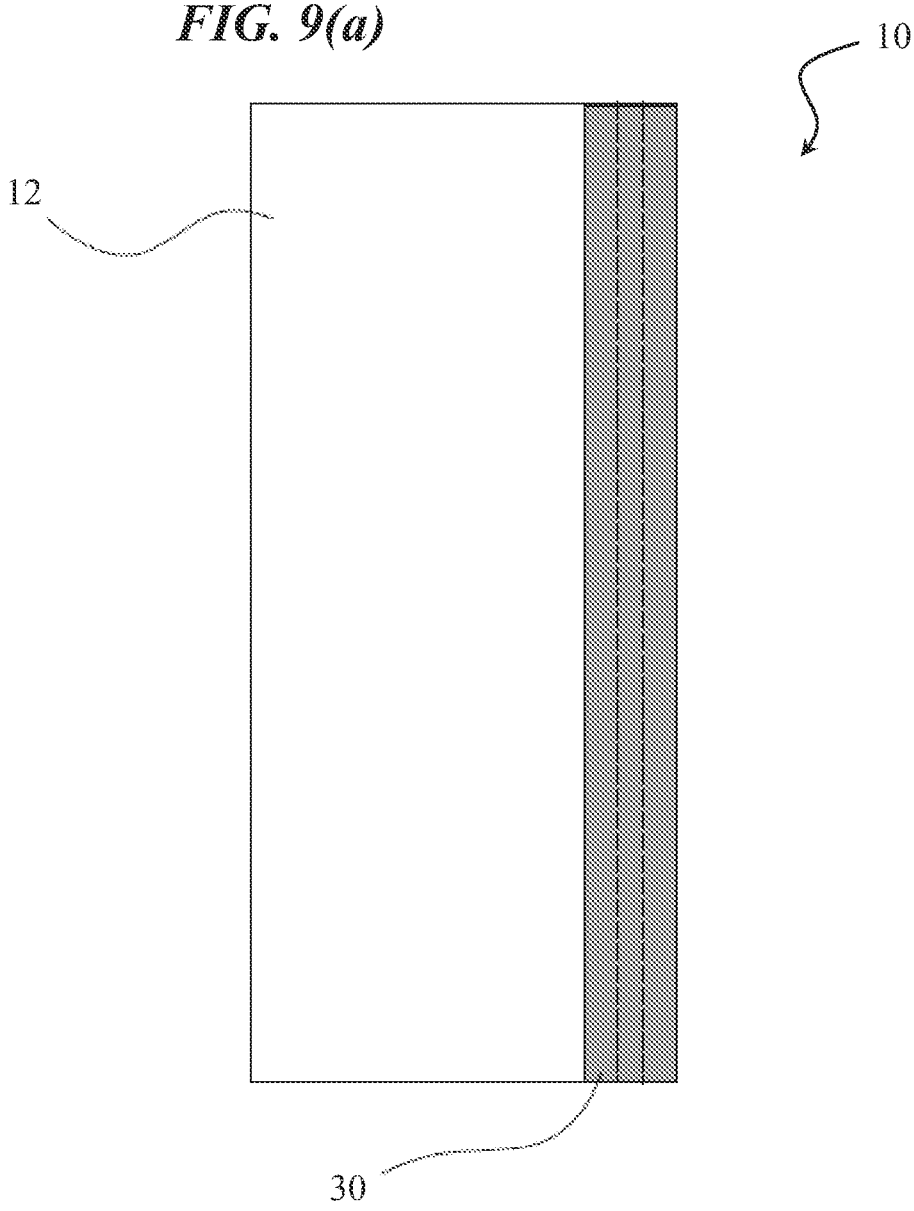

As depicted in FIGS. 9(*a*)-9(*b*), an embodiment of the laminate system includes a flashing 10 used as a trim piece. Flashing 10 can be generally rectangular in shape and includes rigid backer 12 having an upper edge, a lower edge, a first side edge, a second side edge, a front surface, and a rear surface. In this embodiment, rigid backer 12 extends and terminates at gasket 30, whereas rigid backer 12 extends to the opposite side of gasket 30 in FIGS. 7(*a*)-7(*b*). Gasket 30 may replace a caulk tray and can be used as an aid for placement of flashing 10. Gasket 30 has approximately the same vertical length as flashing 10 and is disposed along a vertical edge of rigid backer 12.

In this embodiment, flashing 10 includes neither substantially waterproof/water-resistant membranes nor peel away sheets in use.

Rigid backer 12 terminates at gasket 30 using i-shaped slide 32, which serves the purpose of securing flashing 10 into gasket 30. Gasket 30 has an i-shaped void that matches i-shaped slide 32, such that the i-shaped slide 32 can be inserted and fit snugly in the i-shaped void. Though the shape present in this embodiment is an "i", the invention contemplates any shape for the slide and/or for the void to achieve the same result.

Example 10

Figure 10:
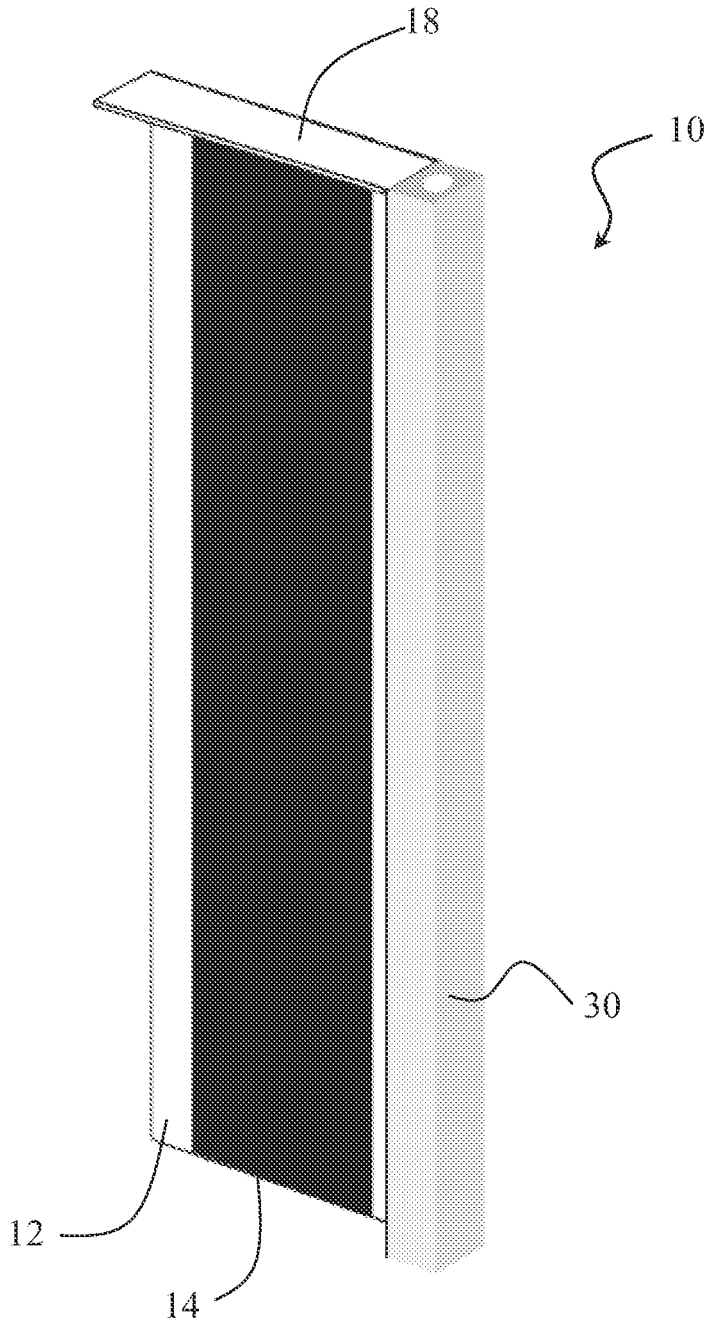
FIG. 10 depicts an upper perspective view of a laminate system for use as a trim piece, the laminate system having a gasket, a substantially waterproof/water-resistant membrane and a top flange.

As depicted in FIG. 10, an embodiment of the laminate system includes a flashing 10 used as a trim piece. Flashing 10 can be generally rectangular in shape and includes rigid backer 12 having an upper edge, a lower edge, a first side edge, a second side edge, a front surface, and a rear surface. In this embodiment, rigid backer 12 extends and terminates at gasket 30, whereas rigid backer 12 extends to the opposite side of gasket 30 in FIGS. 7(*a*)-7(*b*). Rigid backer 12 of flashing 10 abuttingly engages a longitudinal side of gasket 30. Gasket 30 may replace caulk and can be used as an aid for placement of flashing 10. Gasket 30 has approximately the same vertical length as flashing 10 and is disposed along a vertical edge of rigid backer 12.

Substantially waterproof/water-resistant membrane 14 is disposed vertically on the front surface of rigid backer 12 and is adapted to avert the passage of water between an exterior material and a substrate material by creating a drain trough.

Peel away sheet (not shown) may be disposed in overlying relation to substantially waterproof/water-resistant membrane 14. The peel away sheet is removed at the time of installation to expose the adhesive properties that substantially waterproof/water-resistant membrane 14 may contain.

Flashing 10 includes top flange 18 that projects outward at an angle of about 90 degrees from the upper edge of backer 12 towards the front surface of rigid backer 12, creating a horizontal shoulder. In use, top flange 18 is positioned perpendicular to a wall. The bent lip of top flange 18 may help secure the flashing 10 in place, as top flange 18 can fit between juxtaposed planks, planks that overlay one another and/or planks that abut horizontally.

Example 11

Figure 11A:
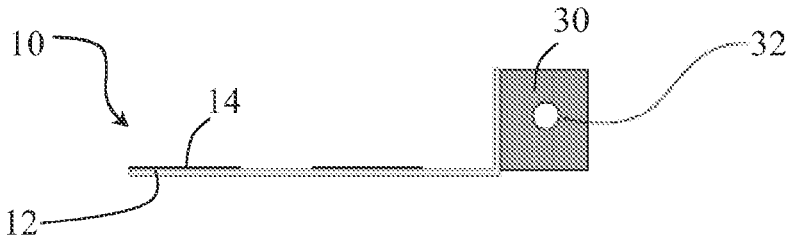
FIG. 11(*a*) depicts a top view of a laminate system for use as a trim piece, the laminate system having a gasket and a plurality of substantially waterproof/water-resistant membrane.
Figure 11B:
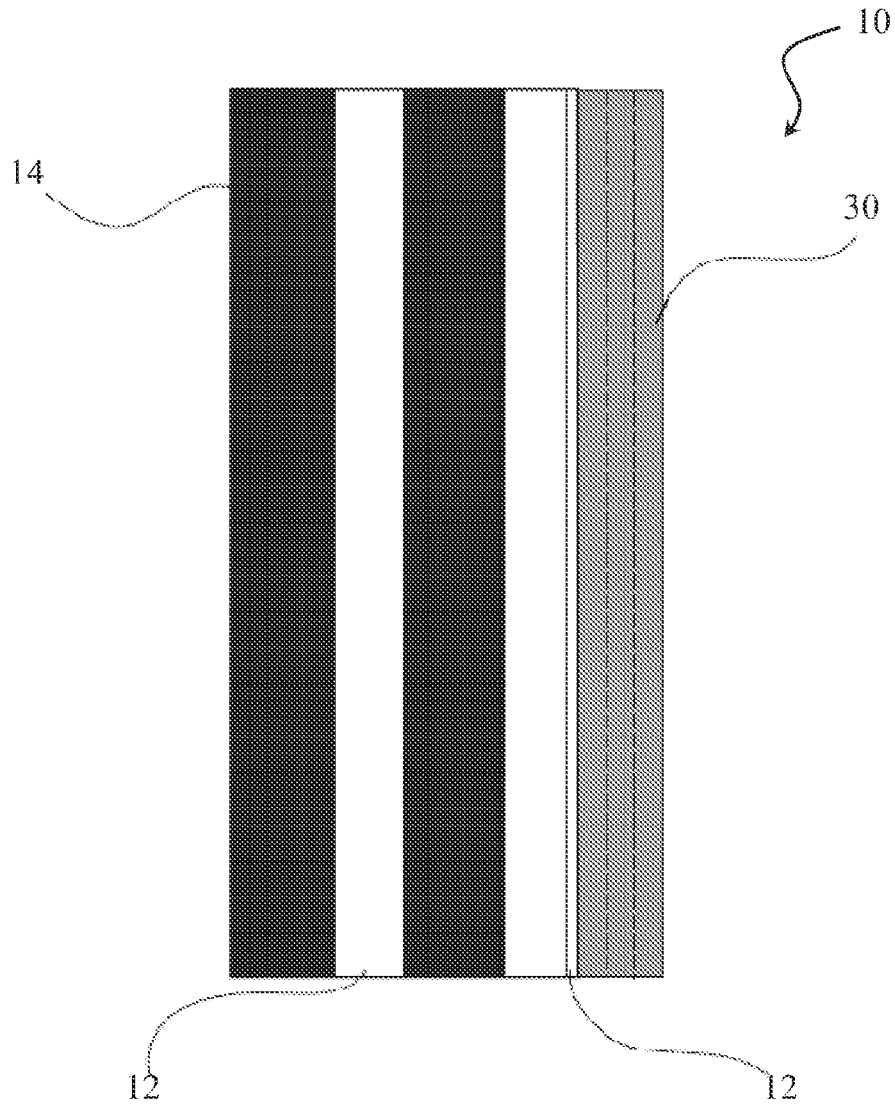

As depicted in FIGS. 11(*a*)-11(*b*), an embodiment of the laminate system includes a flashing 10 used as a trim piece. Flashing 10 can be generally rectangular in shape and includes rigid backer 12 having an upper edge, a lower edge, a first side edge, a second side edge, a front surface, and a rear surface. In this embodiment, rigid backer 12 extends and terminates at gasket 30, whereas rigid backer 12 extends to the opposite side of gasket 30 in FIGS. 7(*a*)-7(*b*). Rigid backer 12 of flashing 10 abuttingly engages a longitudinal side of gasket 30. Gasket 30 may replace caulk and can be used as an aid for placement of flashing 10. Gasket 30 has approximately the same vertical length as flashing 10 and is disposed along a vertical edge of rigid backer 12.

A plurality of substantially waterproof/water-resistant membranes 14 is disposed vertically on the front surface of rigid backer 12 and is adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Example 12

Figure 12A:
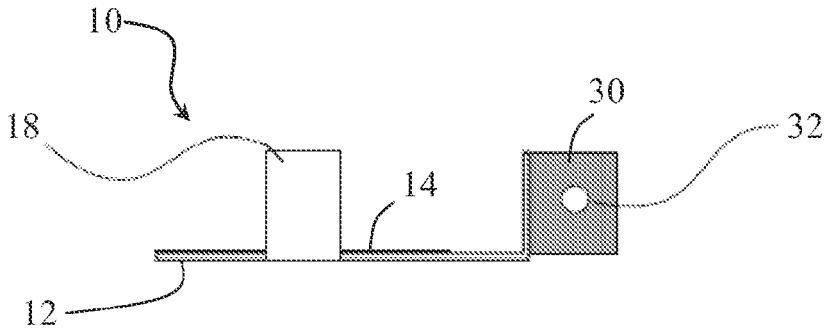
FIG. 12(*b*) depicts a front view of a laminate system for use as a trim piece, the laminate system having a gasket, a plurality of substantially waterproof/water-resistant membrane and a top flange.
Figure 12B:
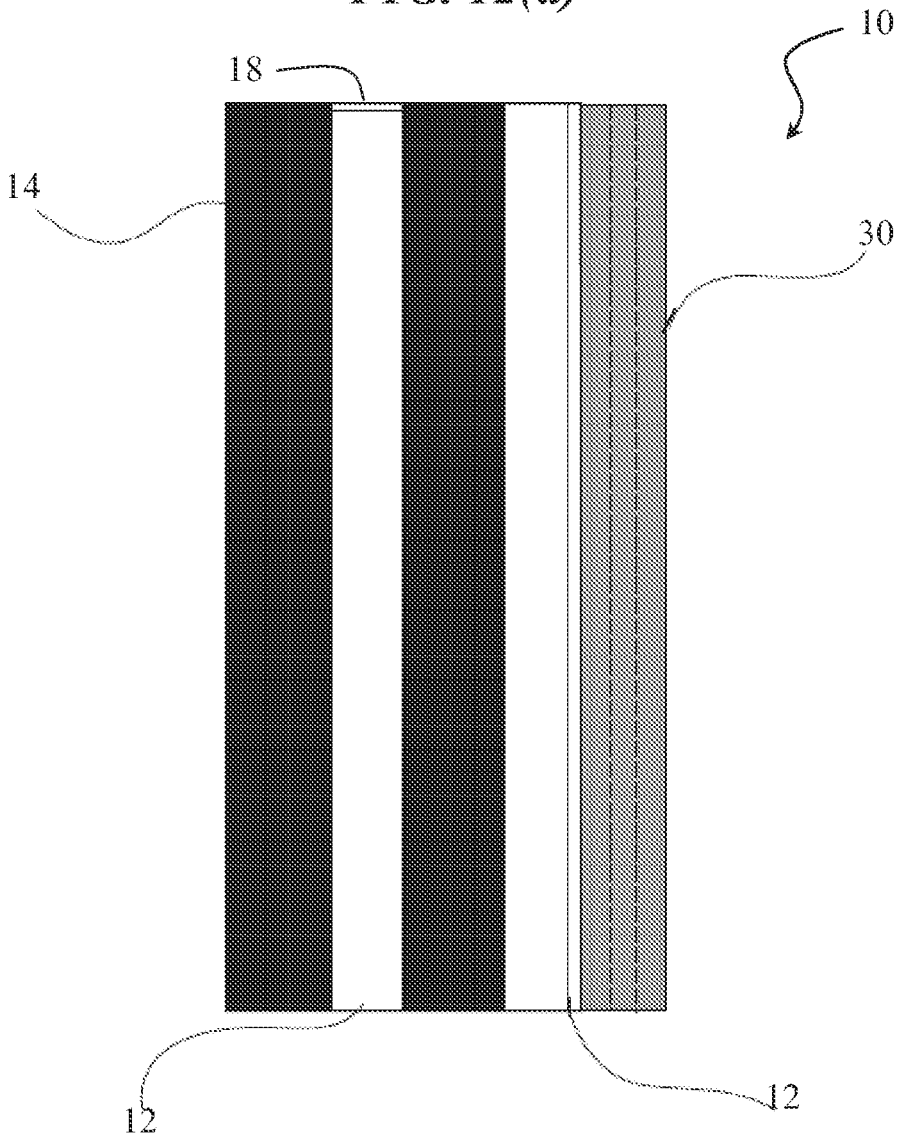

As depicted in FIGS. 12(*a*)-12(*b*), an embodiment of the laminate system includes a flashing 10 used as a trim piece. Flashing 10 can be generally rectangular in shape and includes rigid backer 12 having an upper edge, a lower edge, a first side edge, a second side edge, a front surface, and a rear surface. In this embodiment, rigid backer 12 extends and terminates at gasket 30, whereas rigid backer 12 extends to the opposite side of gasket 30 in FIGS. 7(*a*)-7(*b*). Rigid backer 12 of flashing 10 abuttingly engages a longitudinal side of gasket 30. Gasket 30 may replace caulk and can be used as an aid for placement of flashing 10. Gasket 30 has approximately the same vertical length as flashing 10 and is disposed along a vertical edge of rigid backer 12.

A plurality of substantially waterproof/water-resistant membranes 14 is disposed vertically on the front surface of rigid backer 12 and is adapted to avert the passage of water between an exterior material and a substrate material by creating a drain trough.

Peel away sheets (not shown) may be disposed in overlying relation to the plurality of substantially waterproof/water-resistant membranes 14. Peel away sheets are removed at the time of installation to expose the adhesive properties that the plurality of substantially waterproof/water-resistant membranes 14 may contain.

Flashing 10 includes top flange 18 that projects outward at an angle of about 90 degrees from the upper edge of backer 12 towards the front surface of rigid backer 12, creating a horizontal shoulder. In use, top flange 18 is positioned perpendicular to a wall. The bent lip of top flange 18 may help secure the flashing 10 in place, as top flange 18 can fit between juxtaposed planks, planks that overlay one another and/or planks that abut horizontally. Top flange 18 may also help simplify manufacturing and indicate where to attach a nail/fastener on the corresponding membrane to create the seal or gasket that prevents water intrusion.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A laminate assembly for use in building construction sandwiched between a substantially planar substrate and a substantially planar exterior surface covering, comprising:

a generally rigid flashing panel having an upper edge, a lower edge, a first side edge, a second side edge, a front surface, and a rear surface; and a plurality of vertically-oriented, substantially water impermeable membranes disposed on said flashing panel;

said plurality of membranes being secured to said front surface of said flashing panel in overlying relation to create a seal between said flashing panel and said exterior surface covering, said plurality of membranes creating an interstitial drain trough between said flashing panel and said exterior surface covering;

whereby said laminate assembly inhibits the passage of moisture between said exterior surface covering and said substrate and further inhibits the accumulation of moisture between said flashing panel and said exterior surface covering.

2. A laminate assembly as in claim 1, further comprising a top flange projecting from said upper edge of said flashing panel.

3. A laminate assembly as in claim 2, wherein said top flange is beveled.

4. A laminate assembly as in claim 2, wherein said top flange is bent toward said front surface of said flashing panel at a 90 degree angle.

5. A laminate assembly as in claim 1, wherein each membrane of said plurality of membranes is covered by a peel away sheet.

6. A laminate assembly as in claim 1, further comprising a gasket vertically secured to said front surface of said flashing panel.

7. A laminate assembly as in claim 6, further comprising an i-shaped slide for securing said flashing panel to said gasket.

8. A laminate assembly as in claim 6, wherein said gasket has a square cross-section.

9. A laminate assembly for use in building construction sandwiched between a substantially planar substrate and a substantially planar exterior surface covering, comprising: a generally rigid flashing panel having an upper edge, a lower edge, a first side edge, a second side edge, a front surface, and a rear surface; at least one vertically-oriented, substantially water impermeable membrane disposed on said flashing panel, said at least one membrane being secured to said front surface of said flashing panel in overlying relation to create a seal between said flashing panel and said exterior surface covering; and a gasket vertically secured to a vertical edge of said front surface of said flashing panel; whereby said laminate assembly inhibits the passage of moisture between said exterior surface covering and said substrate and further inhibits the accumulation of moisture between said flashing panel and said exterior surface covering.

10. A laminate assembly as in claim 9, wherein said at least one membrane includes a plurality of substantially water impermeable membranes, said plurality of membranes creating an interstitial drain trough between said flashing panel and said exterior surface covering.

11. A laminate assembly as in claim 9, wherein each membrane of said at least one membrane is covered by a peel away sheet.

12. A laminate assembly as in claim 9, further comprising a top flange projecting from said upper edge of said flashing panel.

13. A laminate assembly as in claim 12, wherein said top flange is bent toward said front surface of said flashing panel at a 90 degree angle.

14. A laminate assembly as in claim 9, wherein said gasket has a square cross-section.

15. A laminate assembly as in claim 9, wherein said flashing panel includes a protrusion that abuttingly engages a vertical side of said gasket.

16. A flashing assembly, comprising:

a first component, said first component comprising:

a first generally rigid flashing panel having an upper edge, a lower edge, a first side edge, a second side edge, a front surface, and a rear surface; and a first plurality of vertically-oriented, substantially water impermeable membranes disposed on said first flashing panel;

said first plurality of membranes being secured to said front surface of said first flashing panel in overlying relation to create a seal between said first flashing panel and a first substantially planar exterior surface covering, said first plurality of membranes creating an interstitial drain trough between said first flashing panel and said first exterior surface covering;

whereby said first component inhibits the passage of moisture between said first exterior surface covering and a first substantially planar substrate and further inhibits the accumulation of moisture between said first flashing panel and said first exterior surface covering;

a second component, said second component comprising:

a second generally rigid flashing panel having an upper edge, a lower edge, a first side edge, a second side edge, a front surface, and a rear surface; and a gasket vertically secured to a vertical edge of said front surface of said second flashing panel;

whereby said second component inhibits the passage of moisture between a second substantially planar exterior surface covering and a second substantially planar substrate and further inhibits the accumulation of moisture between said second flashing panel and said second exterior surface covering.

17. A flashing assembly as in claim 16, wherein said second component further comprises at least one vertically-oriented, substantially water impermeable membrane disposed on said second flashing panel, said at least one water impermeable membrane being secured to said front surface of said second flashing panel in overlying relation to create a seal between said second flashing panel and said second exterior surface covering.

18. A laminate system as in claim 17, wherein said at least one substantially water impermeable membrane includes a second plurality of substantially water impermeable membranes, said second plurality of membranes creating an interstitial drain trough between said second flashing panel and said second exterior surface covering.

* * * * *